US007841557B2

(12) United States Patent
Olbort et al.

(10) Patent No.: US 7,841,557 B2
(45) Date of Patent: Nov. 30, 2010

(54) METHOD FOR UNLOADING A ROLL OF MATERIAL

(75) Inventors: Josef Herbert Olbort, Mainbernheim (DE); Johannes Matthias Rudolf Repp, Erlabrunn (DE); Hartwig Horst Trutschel, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 927 days.

(21) Appl. No.: 11/579,314

(22) PCT Filed: Feb. 4, 2005

(86) PCT No.: PCT/EP2005/050488

§ 371 (c)(1),
(2), (4) Date: Nov. 1, 2006

(87) PCT Pub. No.: WO2005/108254

PCT Pub. Date: Nov. 17, 2005

(65) Prior Publication Data

US 2007/0246597 A1 Oct. 25, 2007

(30) Foreign Application Priority Data

May 3, 2004 (DE) ..... 10 2004 021 604

(51) Int. Cl.
*B65H 16/06* (2006.01)

(52) U.S. Cl. ..... 242/596.4

(58) Field of Classification Search ..... 242/596, 242/596.1, 596.4, 596.5, 596.6, 596.7, 399.1, 242/571, 571.1
See application file for complete search history.

(56) References Cited

U.S. PATENT DOCUMENTS

| | | | | |
|---|---|---|---|---|
| 3,097,808 | A * | 7/1963 | Williams | 242/571.1 |
| 4,211,375 | A | 7/1980 | Weiss et al. | |
| 4,757,953 | A * | 7/1988 | Maier et al. | 242/596.5 |
| 4,903,910 | A | 2/1990 | Tamura | |
| 5,123,604 | A | 6/1992 | Hammer et al. | |
| 5,934,604 | A | 8/1999 | Klimek | |
| 6,042,047 | A * | 3/2000 | Thievessen | 242/596.1 |
| 6,786,443 | B2 | 9/2004 | Trutschel | |
| 6,953,172 | B2 | 10/2005 | Moser | |
| 2002/0130214 | A1 * | 9/2002 | Nakamura et al. | 242/596.5 |
| 2003/0071162 | A1 * | 4/2003 | Moser | 242/596.5 |
| 2003/0146338 | A1 * | 8/2003 | Hogberg et al. | 242/596.1 |
| 2005/0211820 | A1 | 9/2005 | Rosch | |
| 2009/0134267 | A1 * | 5/2009 | Kroger | 242/596.1 |

FOREIGN PATENT DOCUMENTS

| | | |
|---|---|---|
| DE | 26 31 355 | 1/1978 |

(Continued)

*Primary Examiner*—William A Rivera
(74) *Attorney, Agent, or Firm*—Jones, Tuller & Cooper, P.C.

(57) ABSTRACT

A roll of material is unloaded from a roll changer of a web-processing machine. The roll changer includes a first arm having a first axle journal and a second arm having a second axle journal. The roll of material is rotatably supported between these two spaced axle journals. The first arm is moved axially outwardly until the first end of the roll is stripped off the first axle journal. The second arm is then also moved axially outwardly until the roll of material is stripped off the second axle journal.

22 Claims, 4 Drawing Sheets

FOREIGN PATENT DOCUMENTS

| | | |
|---|---|---|
| DE | 28 14 338 | 10/1979 |
| DE | 40 13 092 | 9/1991 |
| DE | 100 46 164 | 4/2002 |
| DE | 101 50 810 | 4/2003 |
| EP | 0 391 061 | 10/1990 |
| WO | WO 02/40387 | 5/2002 |
| WO | WO 03/104118 | 5/2003 |

* cited by examiner

METHOD FOR UNLOADING A ROLL OF MATERIAL

CROSS-REFERENCE TO RELATED APPLICATIONS

This U.S. patent application is the U.S. national phase, under 35 USC 371, of PCT/EP2005/050488, filed Feb. 4, 2005; published as WO 2005/108254 A1 on Nov. 17, 2005, and claiming priority to DE 10 2004 021 604.5, filed May 3, 2004, the disclosures of which are expressly incorporated herein by reference.

FIELD OF THE INVENTION

The present invention is directed to methods for unloading a roll of material. The roll of material is unloaded from a roll changer which has spaced first and second arms, each with an axle journal. The roll of material is rotatably supported by these two arms. The first and second arms are each moved serially outwardly to strip the roll from the first arm and then from the second arm.

BACKGROUND OF THE INVENTION

Methods for unloading a roll of material are used frequently, but by no means exclusively, in, for example, web-fed rotary printing presses to remove finished or partially used rolls of material from a roll changer. To ensure a reliable stripping of the roll of material from the axle journals of the roll changer, stripping devices, such as stripper rings, are provided in generally known roll changers.

A method for unloading a roll of material from a roll changer of a web-fed rotary printing press is described in DE 101 50 810 A1. In this method, the stripping devices are actuated, in a position-controlled or a position-regulated manner. As the axle journals of the roll arms are being moved apart, the stripping devices move along the same path as the roll arm, but in the opposite direction relative to the axle journals. As a result, the residual roll does not change its position during the separation of the roll arms and the associated stripping of the residual roll from the axle journals of the roll arms.

WO 02/40387 A1 describes a device for producing sleeveless paper rolls. In order to change such paper rolls, the two support journals are pulled back simultaneously.

U.S. Pat. No. 4,903,910 A describes a process for unloading a roll of material in a roll changer. A distance between the support elements is greater than the length of a sleeve. For the safe unloading of the sleeves, strippers are provided.

EP 0 391 061 A1 describes a device for aligning a new roll of material. An alignment device presses against the roll of paper, and thus can move an unlocked transport car on a sliding platform.

SUMMARY OF THE INVENTION

The object of the present invention is to provide methods for unloading a roll of material.

The object of the present invention is attained by provision of a roll changer with first and second roll arms, each of which has a roll end supporting axle journal on which one end of the roll of material is supported. The first roll arm is moved axially outwardly until the first side of the roll of material is stripped from the first axle journal. The second roll arm is then also moved axially outwardly until the second end of the roll of material is stripped from the second axle journal.

The benefits to be achieved with the present invention consist especially in that a position control or a position regulation for a stripping device is not necessary. Instead, the unloading of the roll of material, in the correct position, is achieved because the stripping devices are pressed against the roll of material with specific levels of force, and in a predetermined process sequence.

In a first process step, a first stripping device is pressed, with a first stripping force, against the roll of material. No relative movement between the roll of material and the axle journals initially occurs. This is due to the securely set distance between the roll arms of the roll changer. In a second process step, the roll arms are moved away from one another until the first side of the roll of material is stripped from the first axle journal. Thus, the correctly positioned stripping of the first side of the roll of material from the first axle journal is ensured by the application of a stripping force A by the first stripping device.

Once the first side of the first roll of material is free, a second stripping device presses, with a second stripping force B, against the roll of material. As the two roll arms continue to move away from one another, the second side of the roll of material is now also stripped from the second axle journal.

According to one preferred embodiment of the process in accordance with the present invention, the second stripping force B is greater in magnitude than the first stripping force A. This can be advantageous if the roll of material has not been completely consumed. If that is the case, the roll of material will therefore hang down on one side, under its own weight, once the first side has been stripped from the first axle journal. Because of the tilting moment that this tilting of one end of the roll causes, the frictional forces between the second side of the roll of material and the second axle journal are increased. A correspondingly greater second stripping force B, for stripping the second side of the roll of material from the second axle journal, is thus required.

If clamping devices, for use in securing the roll of material, are provided on each of the axle journals, such as, for example, in the form of clamping jaws, these clamping devices should not simply be simultaneously opened prior to unloading the roll of material. Rather, initially only the first clamping device on the first side of the roll of material should be opened. The second side of the roll of material is thus still secured and cannot separate from the second axle journal. Only after the first side of the roll of material has been completely stripped from the first axle journal is the second clamping device also opened, so that the second stripping device can now strip the second side of the roll of material.

Once the first side of the roll of material has been unloaded from the first axle journal, a potential danger exists that the stripping of the second side of the roll of material, during the outward movement of the second stripping device, may cause the first side of the roll of material to undesirably be pushed back onto the first axle journal. This undesired pushing of the first side of the roll of material back onto the first axle journal can be prevented, in a reliable manner, by securing the first stripping device in its final position once the first side of the roll of material has been stripped from the first axle journal. In this final position, the first stripping device then acts as a stop, which stop reliably prevents the first side of the roll of material from being pushed back onto the first axle journal.

In principle, the first stripping device can be secured in its final position in any manner. One particularly simple manner and method results from the first stripping device being pressed against an end stop with a securing force C, for securing it in its final position. Essentially all other supplementary structural measures can thereby be omitted, since a device for applying the securing force C to the first stripping device must be provided in any case, such as, for example, in the form of a pneumatic or a hydraulic operating cylinder, and an end stop is customarily provided anyway.

It is particularly advantageous for the securing force C to be greater than the second stripping force B. The pushing back of the first stripping device, while the second stripping device is being moved out, is reliably excluded.

If the material on the roll which is being unloaded has not been completely consumed, the weight of the roll of material frequently causes its first side to tilt downward at an angle with respect to the second axle journal during unloading. This downward tilting of the roll of material can cause damage to the second stripping device. This damage is likely to occur because, due to the frictional forces at work between the second end surface of the roll of material and the second stripping device, a downward tilting of the roll of material causes a substantial force load on the second stripping device, which force load the second stripping device is frequently unable to bear. If, for example, the stripping device is structured as a stripper ring, which is moved out in the direction of the longitudinal axis of the roll of material by multiple operating cylinders, the downward tilting of the roll of material can frequently cause the connecting rods of the operating cylinders to bend.

This problem can be prevented by reducing the frictional force between the second end surface of the roll of material to be stripped and the associated stripping device, prior to the downward tilting of the roll of material. These frictional forces are to be reduced to the extent that the second end surface of the roll of material is able to slide along the contact surface of the stripping device. It is therefore particularly advantageous for the second stripping force to be decreased from an initial, higher value to a final, lower value during unloading of the roll of material from the second axle journal. In the selection of an initial value $B_1$ for the second stripping force B, it must be ensured that the second stripping force B is sufficient so that the roll of material can be moved, relative to the second axle journal, at the start of the stripping. By decreasing such a second stripping force B, during the unloading of the second end of the roll from the second axle journal, it is ensured that the frictional force between the second end of the roll of material and the stripping device is decreased. Accordingly, when the roll of material tilts downward, its second end surface is able to slide along the contact surface of the second stripping device, so that no damage to the stripping device will occur.

In principle, the stripping force can be decreased, during unloading, from the initial value $B_1$ to the final value in any manner. According to one preferred embodiment of the present invention, the second stripping force B takes on two values in two respectively assigned phases of the unloading, wherein the values for the stripping force $B_1$ and $B_2$ are each held constant during the two successive phases.

A downward tilting of the roll of material typically occurs when the roll of material has essentially been completely stripped from a cylindrical portion of the second axle journal, and is supported only on the tapered end of the second axle journal. The two successive phases for applying the second stripping force B should therefore be oriented in a transition between the cylindrical portion of the second axle journal and the tapered portion of the second axle journal.

In order to be able to transport the roll of material away from the roll changer, following its unloading and without manual intervention to the greatest extent possible, a correspondingly suited transport assembly can be used. To accomplish this roll of material transport, the transport assembly may be arranged beneath the roll of material, before the roll of material has been stripped from the first axle journal, or before the roll of material has been stripped from the second axle journal. In this manner, the transport assembly can receive the unloaded roll of material, and can then transport it back to a material storage area, or can transport an emptied material roll to a disposal area.

The downward tilting of the roll of material, after only one side has been unloaded, can be prevented in a simple manner by providing a height-adjustable support device on the transport assembly. This height-adjustable support device can be structured, for example, in the manner of a scissor lift platform. Either before, or both before and during unloading of the roll of material, the support unit is brought close to, or is placed against the circumference of the roll of material. The downward tilting of one side of the roll of material is correspondingly reduced or is entirely eliminated.

An automatic advancement of the transport assembly is accomplished by the provision of a correspondingly suited drive mechanism, such as, for example, a chain conveyor which can be arranged beneath the floor. In this arrangement, it is particularly advantageous for a coupling device to be provided between the transport assembly and the drive mechanism. Once the transport assembly has been placed in the correct position beneath the roll of material, the coupling device can be uncoupled. This allows the transport assembly, once it is in contact with the roll of material, to follow any longitudinal movements of the roll of material during unloading. Damage to the circumference of the roll of material, which may be caused by an unintended relative movement between the transport assembly and the roll of material is thus prevented. Furthermore, in this manner the optimal position for the roll of material on the transport assembly is maintained during unloading of the roll of material, without any additional steps.

BRIEF DESCRIPTION OF THE DRAWINGS

A preferred embodiment of the present invention is represented in the set of drawings and will be described in greater detail below.

The drawings show in.

DESCRIPTION OF THE PREFERRED EMBODIMENT

Figure 1:
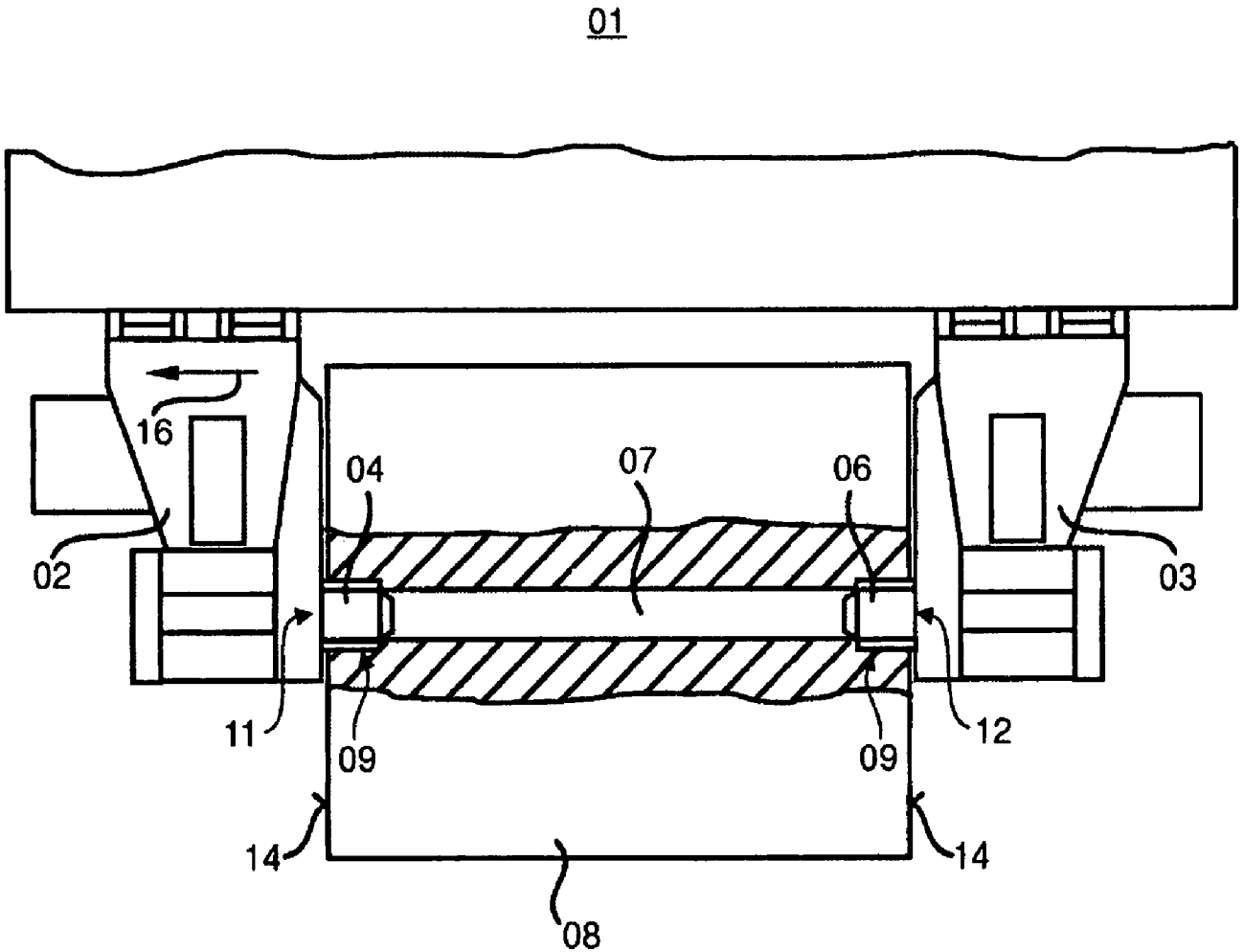
FIG. 1 a schematically represented front elevation view of a roll changer in a first phase of unloading a roll of material.

Referring initially to FIG. 1 there may be seen a roll changer 01, for example a roll changer 01 which is intended for use with a web-fed rotary printing press, with two roll arms 02; 03. It will be understood that roll changer 01 is schematically represented in FIG. 1. On a first roll arm 02 of the roll changer, a first axle journal 04 is provided, and on a second roll arm 03 of the roll changer, a second axle journal 06 is provided, which axle journals 04; 06 are each inserted into one end of a cylindrical recess 07 in a roll of material 08.

The roll of material 08 can thus be rotatably mounted on the roll changer 01. To secure the roll of material 08 on the axle journals 04; 06, the axle journals 04; 06 are each equipped with clamping devices 09 on their respective cylindrical sections. The clamping devices 09 are structured in the manner of clamping jaws 09 and can each be pressed against an inner circumference of the cylindrical recess 07 by actuating corresponding actuation devices on the roll arms 02; 03.

The roll changer 01 is equipped with a second pair of roll arms, which are not shown in FIG. 1, and which are provided for the purpose of accommodating a second roll of material and/or a residual roll. This second pair of roll arms is preferably identical in structure to the first pair of roll arms 02; 03. The two roll arms 02; 03 are mounted so as to pivot around a pivoting axis.

The clamping devices 09 are equipped with elements that can be moved in a radial direction. The clamping devices 09, such as the clamping jaws 09 can be radially spread by the radially movable elements.

A first stripping device 11 is provided on the first roll arm 02, and a second stripping device 12 is provided on the second roll arm 03. The two stripping devices 11; 12 are both structured in the manner of stripper rings 11; 12 and can be pressed, by the operation of pneumatic operating cylinders 13, as may be seen in FIGS. 2 and 3, against the end surfaces 14 of the roll of material 08.

The process for unloading the roll of material 08 from the roll changer 01, in accordance with the present invention is set forth, as follows:

Initially, the first stripping device 11 is pressed, with a first stripping force A, against the left end surface 14 of the roll of material 08. The clamping device 09 on the first axle journal 04 is then opened or released. To unload the left end surface 14 of the roll of material 08 from the first axle journal 04, the first roll arm 02 is moved axially toward the outside in the direction of the movement arrow 16 shown in FIG. 1, in order to increase the distance between the roll arms 02 and 03. Because the right side of the roll of material 08 is still secured by the clamping device 09 of the second axle journal 06, the separation of the roll arms 02 and 03 from one another causes the first axle journal 04 to be drawn out of the left end of the cylindrical recess 07, as seen in FIG. 1. This withdrawing movement is supported by an outward movement of the first stripping device 11 with the first stripping force A. An unintended withdrawal of the right side of the roll of material 08 from the second axle journal 06 is thus excluded.

Figure 2:
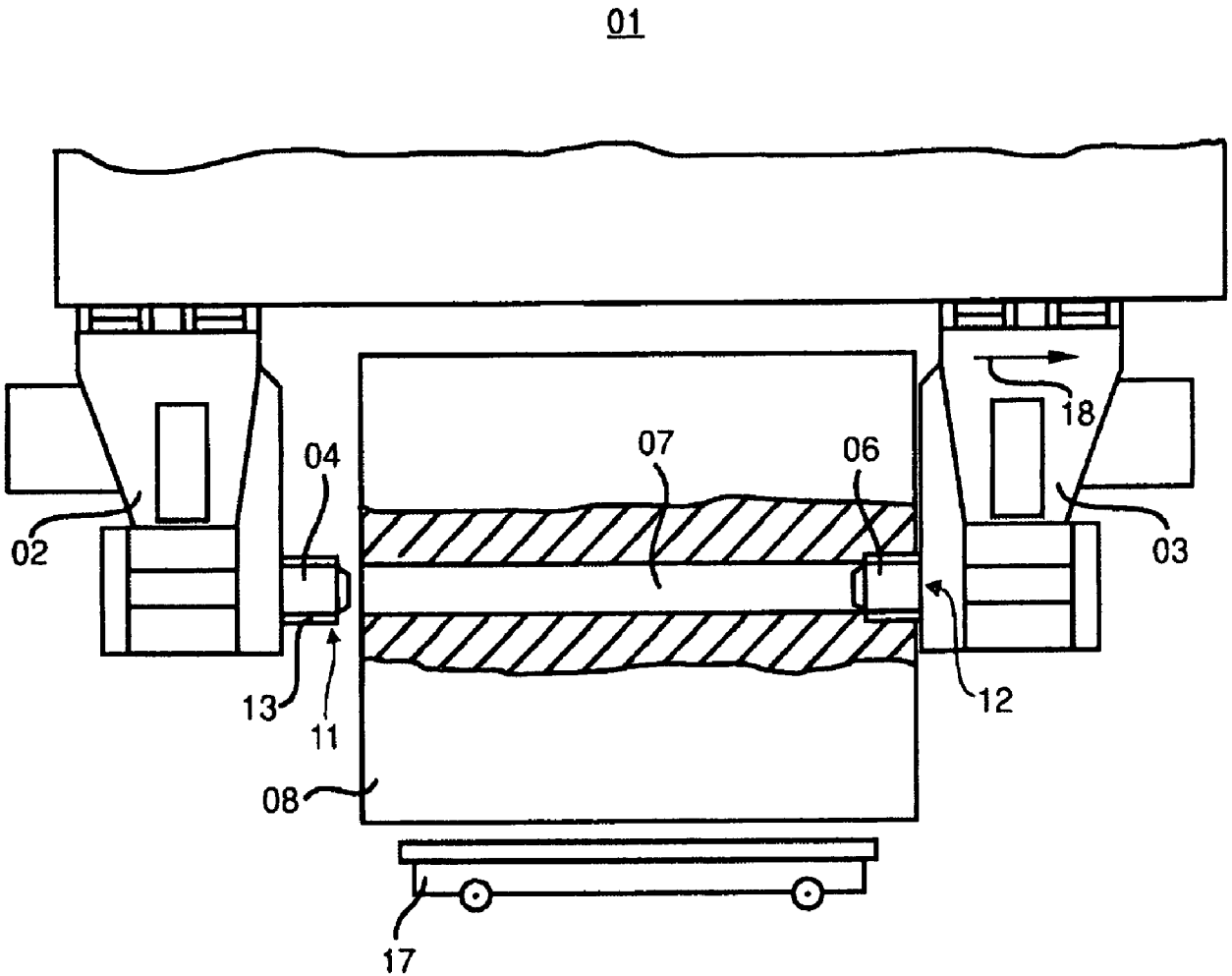
in FIG. 2 the roll changer according to FIG. 1 in a second phase of unloading a roll of material.

FIG. 2 shows the roll of material 08, after its left side has been unloaded from the first axle journal 04. It is apparent that the first stripping device 11 has now been completely withdrawn from the roll core or cylindrical recess 07. The stripping device 11 is secured in this withdrawn position by an impingement of the operating cylinder 13 at a higher operational pressure of, for example, 6 bar. In this manner, an unintended shifting of the left side of the roll of material 08 back onto the first axle journal 04, during the continued unloading process is prevented. At this point, at the latest, a transport 17 assembly is arranged beneath the roll of material 08 for the purpose of transporting the roll of material 08 away from the roll changer after unloading of the roll of material 08.

To now also unload the right side of the roll of material 08, the second stripping device 12 is acted upon by the initial value $B_1$ of a second stripping force B, and the clamping device 09 of the second axle journal 06 is opened. As a result of the stripping force B which is exerted by the second stripping device 12, the roll of material 08 is first pressed against the now secured first stripping device 11. The second roll arm 03 is then moved toward the right, as indicated by the movement arrow 18 shown in FIG. 2, in order to thus further increase the axial spacing distance between the roll arms 03 and 02. Because of the now greater axial spacing distance between the roll arms 02 and 03, the right side of the roll of material 08, in response to the outward movement of the second stripping device 12, is now stripped from the second axle journal 06. Shortly before the roll of material 08 is completely stripped from the cylindrical portion of the second axle journal 06, the stripping force B of the second stripping device 12 is reduced to the final value $B_2$. The frictional force between the right end surface 14 and the second stripping device 12 is decreased and any damage to the operating cylinder 13, which might be caused by a downward tilting of the roll of material 08, is thus prevented.

Figure 3:
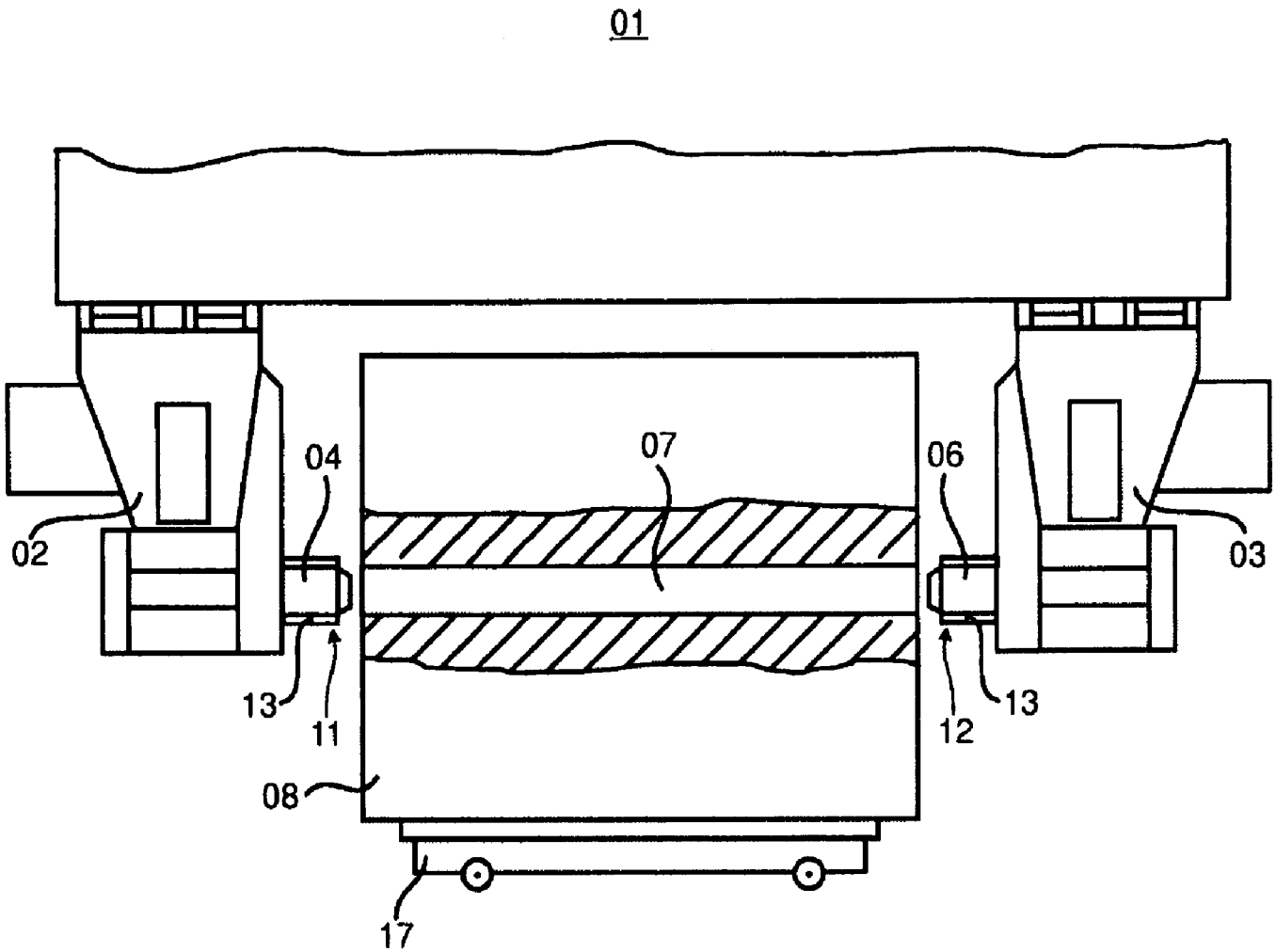
in FIG. 3 the roll changer according to FIG. 1 in a third phase of unloading a roll of material; and in FIG. 4 a diagram of the forces of pressure on the stripping devices of the roll changer depicted in FIG. 1, during the various phases of unloading of a roll of material, as depicted in FIGS. 1-3.

In FIG. 3 the now completely unloaded roll of material 08 is shown. The roll of material 08 lies with its full surface on the transport 17 assembly, and can now be automatically transported away from the roll changer 01.

Figure 4:
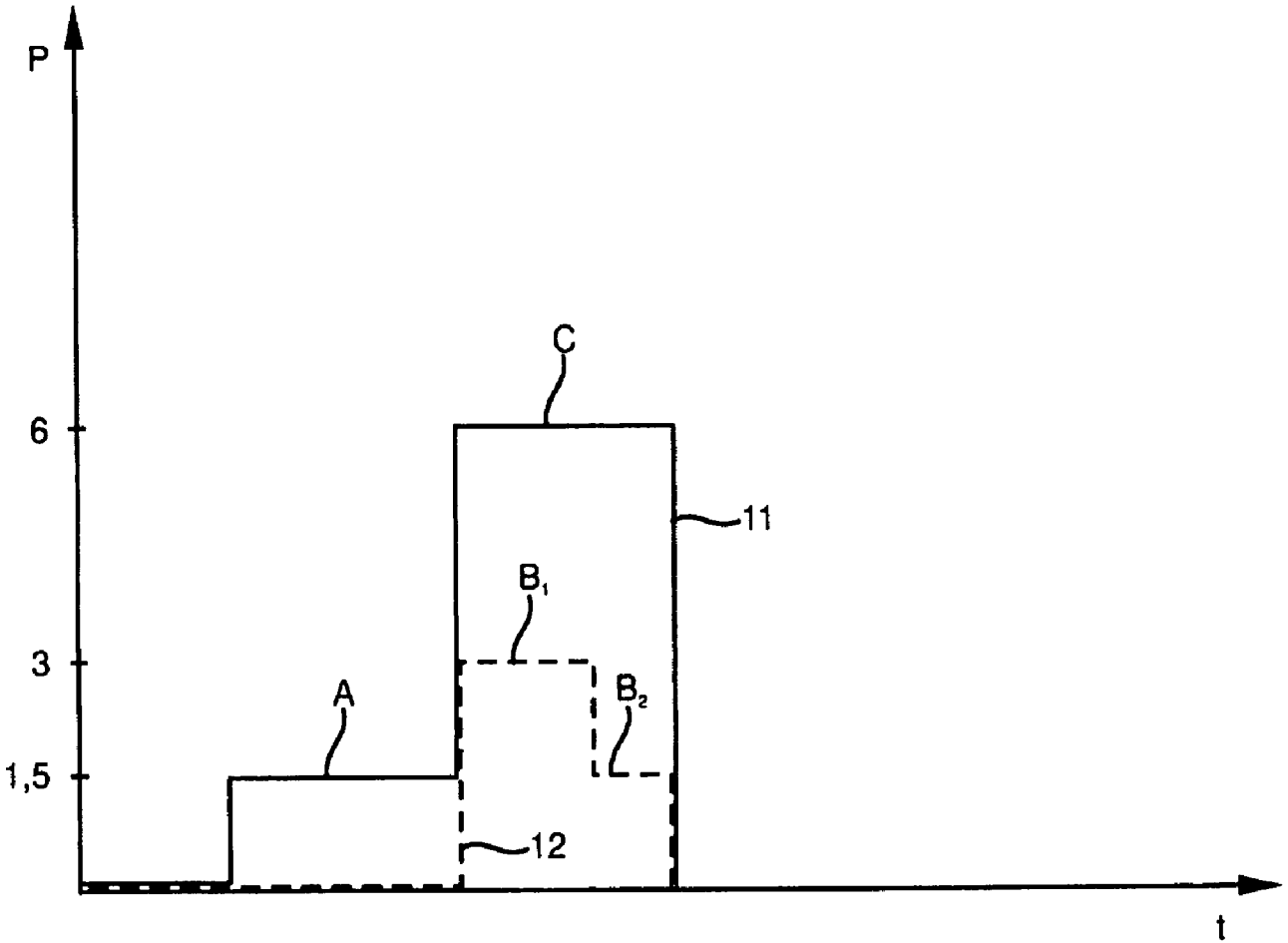

In FIG. 4, the drive pressures for the stripping devices 11; 12, during the unloading of the roll of material 08, are schematically represented. The drive pressure for the first stripping device 11 is represented by a continuous line, and the drive pressure for the second stripping device 12 is represented by a dashed line.

As is illustrated in FIG. 4, during the unloading of the left side of the roll of material 08, the first stripping device 11 is acted upon by a positive pressure of 1.5 bar, in order, in this manner, to generate the first stripping force A. After the complete stripping of the left side of the roll of material 08, the first stripping device 11 is then acted upon by a positive pressure of 6 bar, in order to generate the subsequent securing force C.

During the unloading of the left side of the roll of material 08, the second stripping device 12 is initially not pressurized. Once the first stripping device 11 has been provided with the securing force C, the second stripping device 12 is then initially acted upon by a positive pressure of 3 bar, in order, in this manner, to generate the initial value $B_1$ for the second stripping force B. In a second phase of the stripping of the right side of the roll of material 08 from the second roll arm 03, the pressure of the second stripping device 12 is then reduced to a positive pressure of 1.5 bar, which positive pressure corresponds to the final value $B_2$ for the second stripping force B.

While a preferred embodiment of a method for unloading a roll of material, in accordance with the present invention, has been set forth fully and completely hereinabove, it will be apparent to one of skill in the art that various changes in, for example, the overall structure of the roll changer, the structure used to move the transport assembly, and the like could be made without departing from the true spirit and scope of the present invention which is accordingly to be limited only by the appended claims.

What is claimed is:

1. A method for unloading a roll of material from a roll changer of a web-processing machine including:

providing a first roll arm in said roll changer;

providing a second roll arm in said roll changer;

providing a first roll of material end supporting first axle journal on said first roll arm;

providing a first roll of material end clamping device on said first axle journal;

providing a second roll of material end supporting second axle journal on said second roll arm;

providing a second roll of material end clamping device on said second axle journal;

using said first roll of material end clamping device for securing said first roll of material end on said first axle journal;

using said first axle journal for rotatably supporting said first end of the roll of material;

using said second roll of material end clamping device for securing said second roll of material end on said second axle journal;

using said second axle journal for rotatably supporting said second end of the roll of material;

releasing said first roll of material end clamping device;

moving said first roll arm in a first axial direction with respect to said first end of the roll of material after said releasing of said first roll of material end clamping device;

separating said first axle journal from said first roll of material end while maintaining said second clamping device securing said second roll of material end on said second axle journal;

subsequently releasing said second roll of material end clamping device;

moving said second roll arm in a second axial direction with respect to said second end of the roll of material;

selecting said first axial direction and said second axial direction being opposite to each other; and separating said second axle journal from said second roll of material end in response to said subsequent moving of said second roll arm in said second axial direction opposite to said first axial direction of movement of said first roll arm.

2. The method of claim 1 further including providing a first stripping device cooperating with said first axle journal and a second stripping device cooperating with said second axle journal, and engaging said first stripping device against said first end of the roll of material with a first stripping force during said separating of said first axle journal from said first end of the roll of material.

3. The method of claim 2 further including engaging said second stripping device against said second end of the roll of material with a second stripping force during said separating of said second axle journal from said end of the roll of material.

4. The method of claim 3 wherein said second stripping force is greater than said first stripping force.

5. The method of claim 3 further including decreasing said second stripping force from an initial value to a final value.

6. The method of claim 5 further including initially applying said initial second stripping force at a constant level during a first phase of said separating said second axle journal from said second end of the roll of material and then applying said final second stripping force at a constant level during a second phase of said separating said second axle journal from said second end of the roll of material.

7. The method of claim 6 further including ending said first phase when said second end of the roll of material has been stripped from a cylindrical portion of said second axle journal and beginning said second phase as soon as said second end of the roll of material is being stripped from a tapered portion of said second axle journal.

8. The method of claim 5 further including providing said initial value of said second stripping force as a positive pressure of 3 bar.

9. The method of claim 8 further including providing said final value of said second stripping force as a positive pressure of 1.5 bar.

10. The method of claim 3 further including providing said second stripping force as a positive pressure of 3 bar.

11. The method of claim 2 further including securing said first stripping device in a final position after stripping said first end of the roll of material from said first axle journal.

12. The method of claim 11 further including providing a first end stop and pressing said first stripping device against said first end stop with a securing force for securing said first stripping device in said final position.

13. The method of claim 12 wherein said securing force is greater than said first stripping force.

14. The method of claim 12 further including providing said securing force as a positive pressure of 6 bar.

15. The method of claim 2 further including providing each of said first and second stripping devices as a stripper ring.

16. The method of claim 2 further including actuating each one of said first and second stripping devices using one of hydraulic and pneumatic pressure.

17. The method of claim 2 further including providing said first stripping force as a positive pressure of 1.5 bar.

18. The method of claim 1 further including providing a roll transport assembly and arranging said roll transport assembly in a roll receiving position before one of said moving of said first roll arm and said moving of said second roll arm.

19. The method of claim 18 further including providing a roll transport drive and a coupling device between said roll transport assembly and said roll transport drive and disengaging said coupling device when said roll transport assembly is in said roll receiving position.

20. The method of claim 19 further including contacting said roll transport assembly with the roll of material and moving said roll transport assembly in a longitudinal direction of the roil of material in response to said contact.

21. The method of claim 18 further including providing a height-adjustable roll support on said roll transport assembly and moving said roll support into engagement with the roll of material.

22. The method of claim 1 further including providing each said first and second roll of material end clamping device being spreadable in a radial direction of the associated one of said first and second axle journals.

* * * * *

UNITED STATES PATENT AND TRADEMARK OFFICE

CERTIFICATE OF CORRECTION

PATENT NO. : 7,841,557 B2
APPLICATION NO. : 11/579314
DATED : November 30, 2010
INVENTOR(S) : Josef Herbert Olbort et al.

It is certified that error appears in the above-identified patent and that said Letters Patent is hereby corrected as shown below:

Column 7, in claim 3, line 41, before "end" insert -- second --.

Signed and Sealed this
Eighth Day of February, 2011

David J. Kappos

David J. Kappos
*Director of the United States Patent and Trademark Office*